United States Patent [19]

Parsons et al.

[11] Patent Number: 5,060,437

[45] **Date of Patent: * Oct. 29, 1991**

[54] BREAKAWAY UTILITY POLE

[75] Inventors: James H. Parsons, Prosperity; Philippe H. McLain, Columbia; John F. Boozer, III, Pomaria; John R. Lewis, Jr., Chapin, all of S.C.

[73] Assignee: Shakespeare Company, Newberry, S.C.

[ * ] Notice: The portion of the term of this patent subsequent to May 1, 2007 has been disclaimed.

[21] Appl. No.: 432,571

[22] Filed: Nov. 6, 1989

Related U.S. Application Data

[63] Continuation-in-part of Ser. No. 332,553, Apr. 3, 1989, Pat. No. 4,920,715, which is a continuation-in-part of Ser. No. 165,530, Mar. 8, 1988, and Ser. No. 165,620, Mar. 8, 1988.

[51] Int. Cl.[5] ..... E02D 27/42

[52] U.S. Cl. ..... 52/298; 52/704; 404/10

[58] Field of Search ..... 52/298

[56] References Cited

U.S. PATENT DOCUMENTS 4,920,715 5/1990 Parsons et al. ..... 52/298

*Primary Examiner*—Richard E. Chilcot, Jr.
*Assistant Examiner*—Kien T. Nguyen
*Attorney, Agent, or Firm*—Renner, Kenner, Greive, Bobak, Taylor & Weber

[57] ABSTRACT

A breakaway utility pole (9, 109) mounting structure. The mounting structure presents a base portion (11', 16 or 20) within which the end portion (10, 110) of the pole (9, 109) is telescopically received. The base portion (11', 16 or 20) of the mounting structure extends below ground level, and an adhesive material (17, 117) bonds the pole end portion (10, 110) to the base portion (11', 16 or 20). The adhesive material (17, 117) is adapted to fail when the pole (9, 109) is subjected to an impact at a predetermined distance above ground level from a vehicle of predetermined minimum weight moving at a predetermined minimum speed.

6 Claims, 10 Drawing Sheets

BREAKAWAY UTILITY POLE

CROSS REFERENCE TO RELATED APPLICATIONS

This application is a continuation-in-part of U.S. application Ser. No. 332,553, filed Apr. 3, 1989 now U.S. Pat. No. 4,920,715, and directed to a "Breakaway Utility Pole", which is, in turn, a continuation-in-part of U.S. application Ser. No. 165,530, filed on Mar. 8, 1988, and directed to a "Breakaway Utility Poled Inverted Base Structure" and U.S. application Ser. No. 165,620, also filed on Mar. 8, 1988, and directed to a "Breakaway Utility Pole Buried Base Structure."

TECHNICAL FIELD

The present invention relates to highway utility poles, and more particularly to poles for supporting lights, signs, traffic signals and the like, alongside roads and highways.

BACKGROUND OF THE INVENTION

Highway pole structures utilized on federally funded highways projects must meet the breakaway performance criteria when struck by errant vehicles in order to diminish as much as possible serious injury to the occupants of such vehicles resulting from striking such pole structures. Originally, highway poles were wood, steel or concrete, and such poles provided such rigid resistance to impact from vehicles before breaking away that the injury to the occupants was extremely severe or even fatal. Moreover, when such poles did break, not only were the driver and the other occupants subjected to probable further injury after impact by the broken off pole crushing the top of the vehicle, but a jagged stub was often left extending above ground a substantial distance, presenting an additional hazard in the likelihood of damaging the steering or underside of the vehicle, or of crushing the vehicle and occupants from the front after impact.

The present required breakaway performance criteria are set forth in the American Association of State Highway Transportation Officials Publication entitled "Standard Specifications for Structural Supports for Highway Signs, Luminaries and Traffic Signals 1985", which states that when a standard 1800 pound vehicle (or its equivalent) travelling at 20 MPH (29.3 feet per second) strikes the luminary support at 18 inches above ground level (as specified in National Cooperative Highway Research Program (NCHRP) Report 230, page 41), the speed of the vehicle is not to be reduced after break away more than 15 feet per second, and preferably not more than 10 feet per second. Another requirement is that any remaining structure after breakaway shall not extend more than four inches above the ground level. Previously these requirements were based upon 2250 pound vehicles.

Prior pole structures for meeting the criteria with the heavier vehicles, such as grooved breakaway bolts and anchor base fittings of frangible material, have not been satisfactory when tested with lighter vehicles weighing a minimum of 1800 pounds.

In attempting to meet these requirements, highway utility poles have been constructed of lightweight materials such as aluminum and fiberglass, but difficulties have been encountered in providing poles strong enough to resist wind and weight loads while meeting the breakaway requirements, and in avoiding leaving jagged stubs extending more than 4 inches above ground after breakaway.

SUMMARY OF THE INVENTION

It is, therefore, a primary object of the present invention to provide a pole structure which will break away when struck by a vehicle of required minimum weight moving at a predetermined minimum speed.

It is a another object of the present invention to provide a pole structure, as above, which will cause not more than a predetermined minimum reduction in vehicle speed after impact.

It is a further object of the present invention to provide a pole structure, as above, which will not leave any mounting structure projecting more than four inches above ground after impact.

It is still another object of the present invention to provide an attractive lightweight breakaway pole structure which will accomplish the foregoing objectives and provide adequate resistance to wind and weight loads.

It is yet another object of the present invention to provide a pole structure, as above, the will accommodate a telephone call box in such a way that the weight of the telephone call box will not cause the pole on which it is mounted to fall violently against a vehicle which might strike the pole.

These and other objects of the invention, as well as the advantages thereof over existing and prior art forms, which will be apparent in view of the following detailed specification, are accomplished by means hereinafter described and claimed.

Certain exemplary species of the present invention utilize a tubular base section buried upright in the ground and adapted telescopically to receive the bottom end portion of a utility pole, and an adhesive material bonding said end portion within the tubular base section, said adhesive material adapted to fail and release the pole upon impact upon the pole by a moving vehicle.

Exemplary alternative species of the present invention utilize a novel inverted base anchored in the ground and having a tubular portion extending below ground level adapted telescopically to receive the bottom end portion of a utility pole, and an adhesive material bonding said end portion within the base, said adhesive material adapted to fail and release the pole upon impact upon the pole above the base by a vehicle.

DESCRIPTION OF AN EXEMPLARY EMBODIMENT

The perferably tubular pole 9 shown in FIGS. 1–6 may be straight or tapered longitudinally and circular or polygonal in cross-section. It may be made of any of several materials such as steel, aluminum, and other materials such as reinforced fiberglass. It must be strong enough to resist top and wind loading, while subject to failure when tested as prescribed by the American Association of State Highway Transportation Officials publication entitled "Standard Specifications for Structural Supports for Highway Signs, Luminaries and Traffic Signals 1985." Accordingly, the more acceptable materials for breakaway poles are relatively lightweight such as aluminum or reinforced plastics such as fiberglass.

Figure 1:
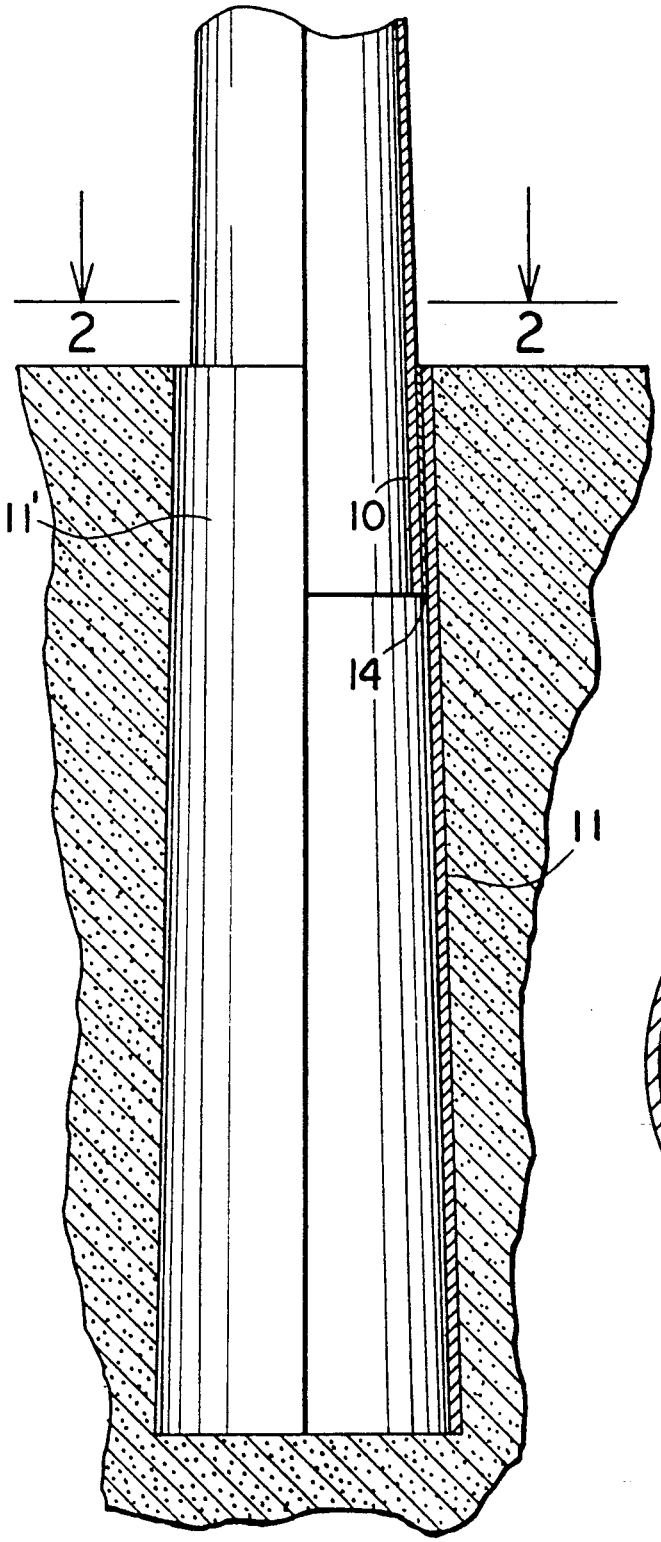
FIG. 1 is a vertical cross-sectional view partly in elevation, of a preferred embodiment of the invention, showing the bottom end of a utility pole received in the upper end of a buried tubular base section.
Figure 2:
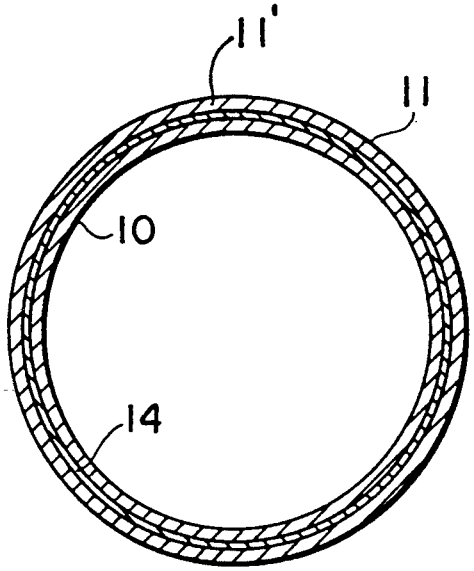
FIG. 2 is an enlarged plan sectional view on line 2—2 of FIG. 1.

As shown is FIG. 1 the lower end portion 10 of pole 9 is telescopically received in the upper portion 11' of a tubular base section 11 which may be of the same or other material, and may be straight longitudinally or tapered as shown. The base section extends downward from the ground level a distance sufficient to provide a secure and solid foundation for the pole in adequately tamped ground. The lower end portion 10 of the pole may extend below ground level within the base section a distance substantially equal to the diameter of said end portion, although this may vary considerably according to various pole diameters.

The lower end portion 10 of pole 9 is bonded to the upper end portion of the base section by a thin layer 14 of the adhesive material extending from the ground level to the bottom end of the pole. This material may be of an epoxy such as Versamid® formulated to fail and release the pole when it is subjected to impact under the conditions prescribed previously herein. The thickness of the adhesive bond 14 may be from about 1/16 inch to 3/16 inch. Versamid is the registered trademark of General Mills Chemicals, Inc.

Figure 3:
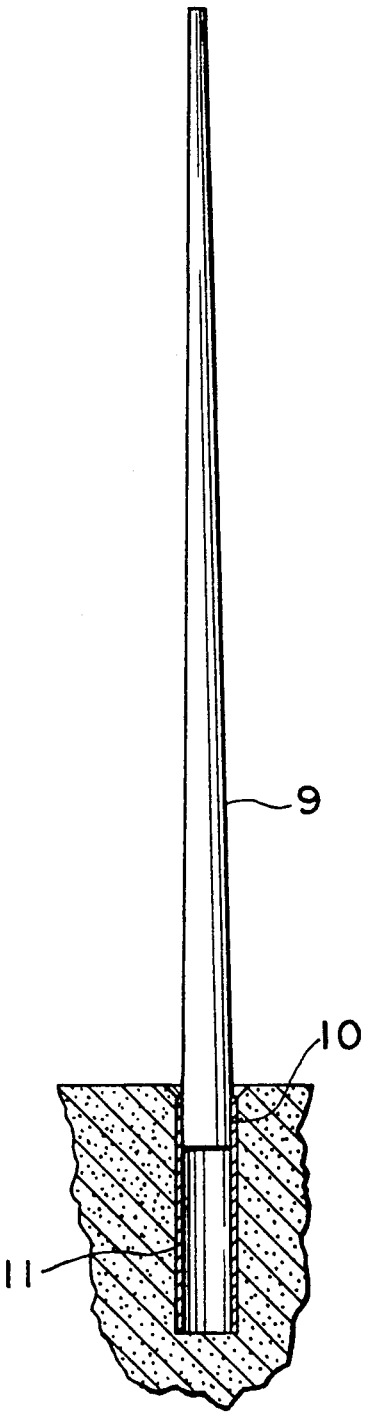
FIGS. 3, 4 and 5 are schematic vertical cross-sectional views showing the progressively changing positions of the pole when breaking away due to horizontal impact by a moving force.
Figure 4:
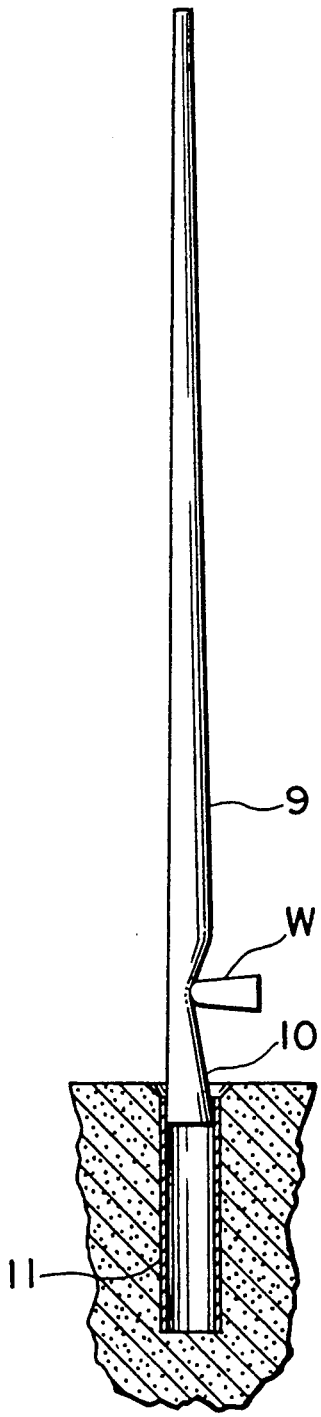
Figure 5:
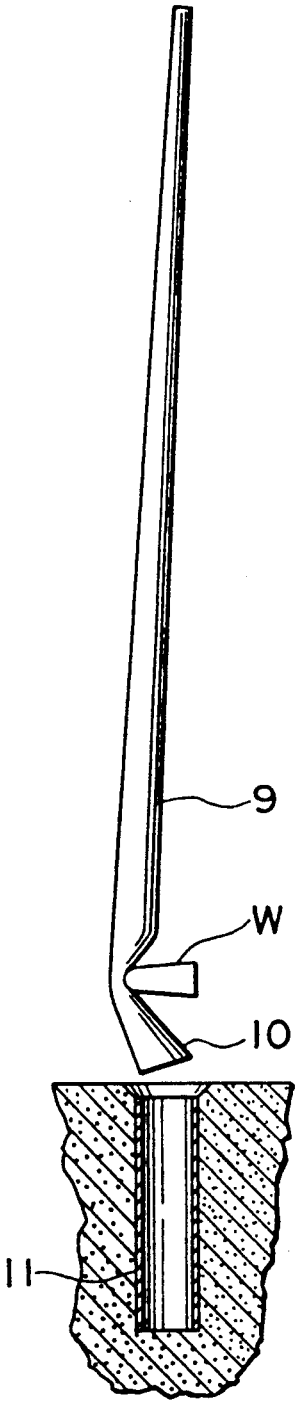

In the sequential depiction of stages during a test, FIG. 3 shows the position of the pole and its mounting before impact, FIG. 4 shows the conditions at impact, and FIG. 5 shows the conditions immediately after impact as the crushed lower end of the pole is being evacuated from the base section 11. A tapered tubular pole 9 of reinforced fiberglass was mounted with its lower end 10 telescopically received in the upper end of a base section 11 buried and tamped in the ground with its upper end substantially level with the ground line. The outer diameter of the pole at ground line was about 8 inches at ground line and its thickness $\frac{1}{4}$ inch. The inner diameter of the upper end of the base section was about 8 inches plus $\frac{1}{8}$ inch to $\frac{3}{8}$ inch and was adhesively bonded to the lower end portion 10 of the pole by Versamid® epoxy adhesive. The lower end portion 10 of the pole extended about 10 inches below ground line. The base section 11 extended about 5 feet below ground line.

The pole extended about 23 ft. above ground and had an outer diameter of $4\frac{7}{8}$ inches at the top with a wall thickness of $\frac{3}{8}$ inch. An 8 foot luminaire arm was attached to the pole 9 inches from the top with a 50 pound weight on the outer end of the arm to simulate the mass of a luminaire. The pole was tested as required by an 1800 pound weight W moving horizontally at 20 miles per hour striking the poles 18 inches above ground level and the pole was crushed and evacuated from the base section in the manner depicted in FIGS. 3, 4 and 5. The change in velocity of the weight W, simulating the mass of a moving vehicle, was from 31.12 feet per second before impact to 22.09 feet per second after impact, a difference of 9.03 feet per second, which is well within the requirements of the American Association of State Highway Transportation Officials, namely: a speed reduction of not more than 15 feet per second, and preferably not more than 10 feet per second. The tubular base section 11 remained completely buried in the ground after the pole 9 was evacuated, although its wall was partly broken in the bond area.

Figure 6:
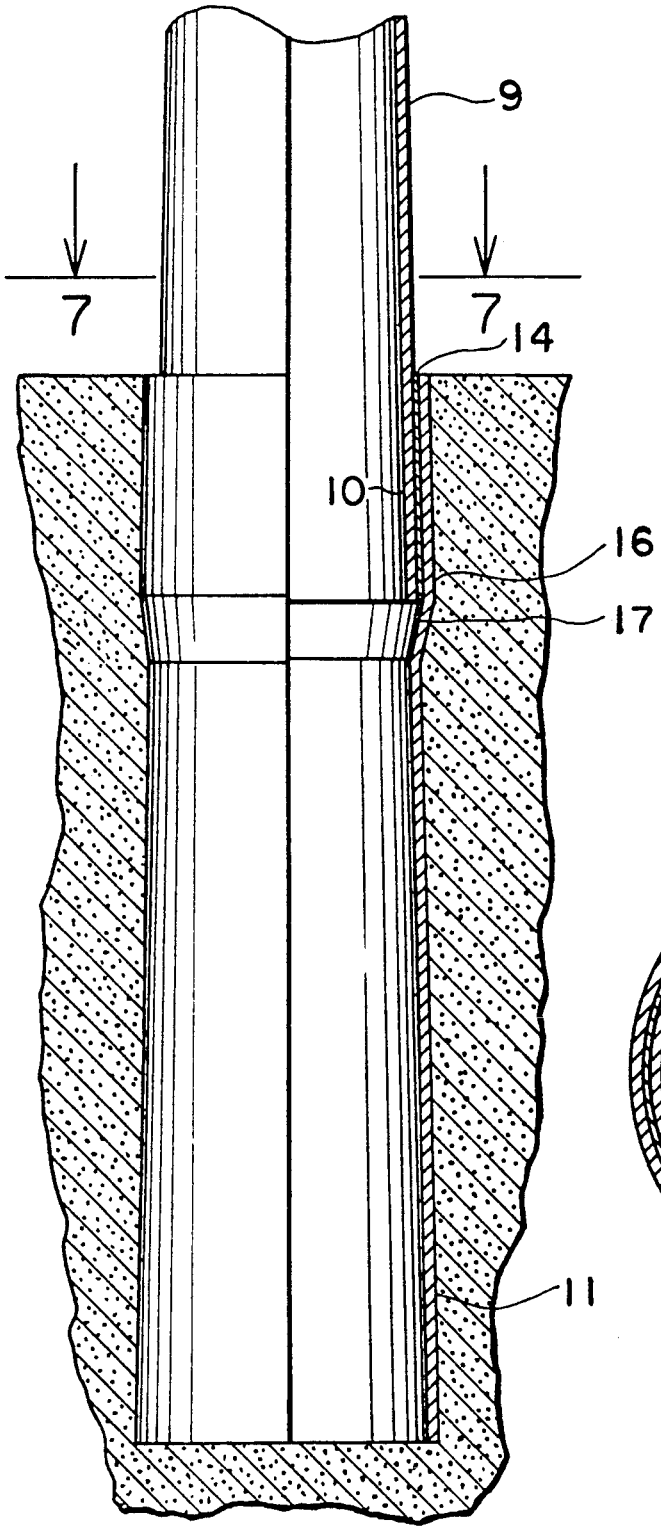
FIG. 6 is a vertical cross-sectional view similar to FIG. 1 of a second embodiment, showing the bottom end of a utility pole telescopically received in the circumferentially enlarged upper end of a buried tubular base section.
Figure 7:
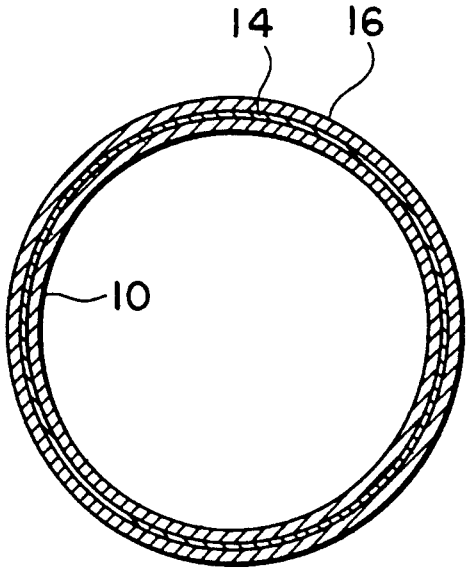
FIG. 7 is an enlarged plan sectional view on line 7—7 of FIG. 6.

The second embodiment of the invention shown in FIGS. 6 and 7 differs from the first embodiment only in that the upper portion of the buried tubular base section 11 which receives the lower end portion 10 of pole is peripherally or curcumferentially enlarged to form an exterior tubular portion 16 surrounding and enclosing the pole end portion 10. The bottom of the tubular portion 16 forms an inclined internal shoulder 17 on which the bottom of the pole 10 may seat, and the pole end portion 10 and the tubular portion 16 are bonded together by adhesive epoxy 14. A similar test was made of this embodiment, using a pole duplicating the pole of the first embodiment and a similar base except for the enlarged ferrule portion 16. The test results were substantially the same in that the bottom portion of the pole was crushed and evacuated from the base section 11, leaving the entire base section in the ground with no part of the pole above gound line. The change in velocity of the weight W, simulating the mass of a moving vehicle, was from 29.53 feet per second before impact to 20.70 feet per second after impact, a difference of 8.83 feet per second, well within the requirements.

Figure 8:
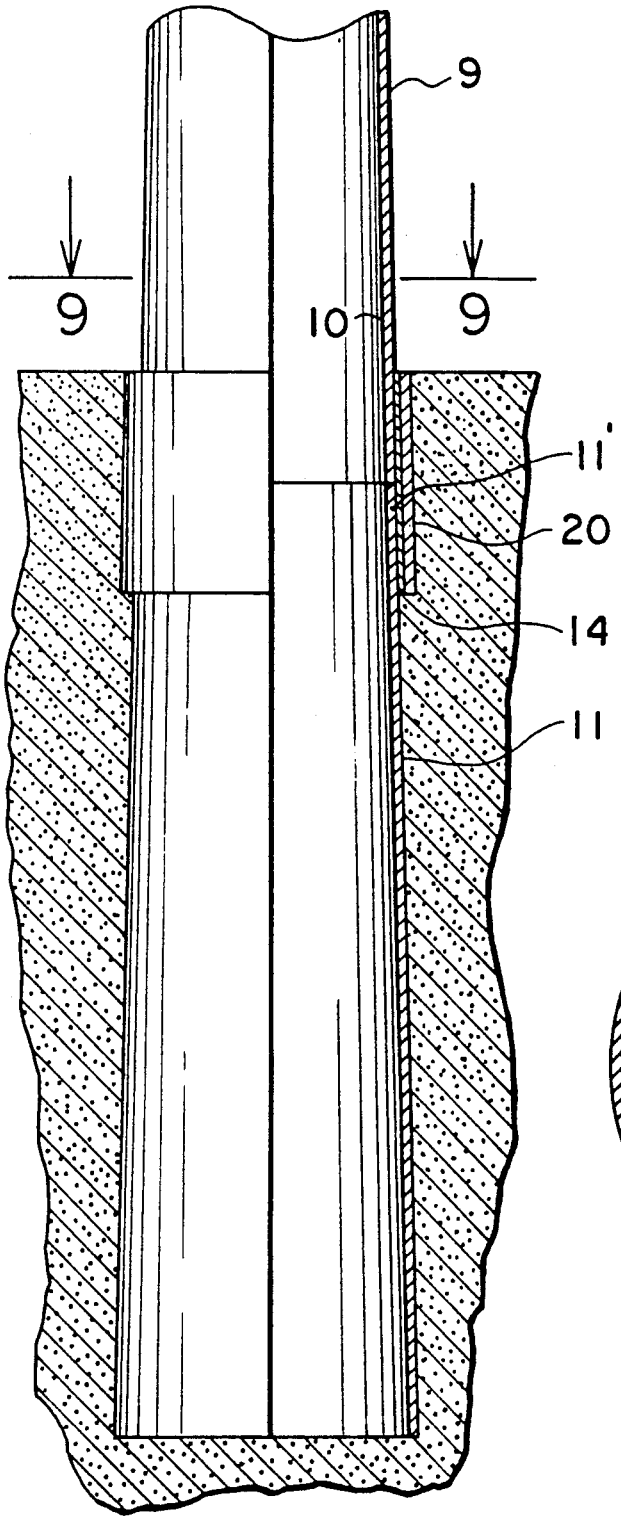
FIG. 8 is a vertical cross-sectional view similar to FIG. 1, of a third embodiment, showing the bottom end of a utility pole abutting the upper end of a buried tubular base section, and telescopically received in a ferrule surrounding and overlapping the abutted joint.
Figure 9:
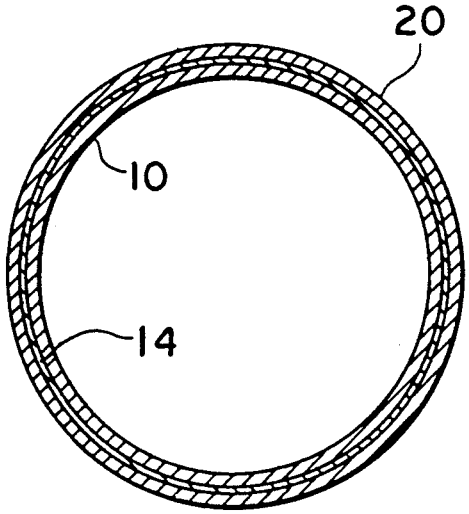
FIG. 9 is an enlarged cross-sectional view on line 9—9 of FIG. 8.

The third embodiment of the invention shown in FIGS. 8 and 9 differs from the first and second embodiments in that the lower end portion 10 of pole 9 is the same diameter as that of the upper end of the base section 11 and is preferably seated thereon, and a separate ferrule section 20 forming part of the base surrounds and telescopically encloses the lower end portion 10 of the pole below ground level and also overlaps and encloses the upper end portion 11' of the base section 11. An epoxy adhesive bond is formed between ferrule section 20 and the enclosed portions of both the pole and the base section 11.

Test results for pole 9 and base section 11 of the third embodiment, and having the same dimensions as those of the second embodiment, are substantially the same.

Figure 10:
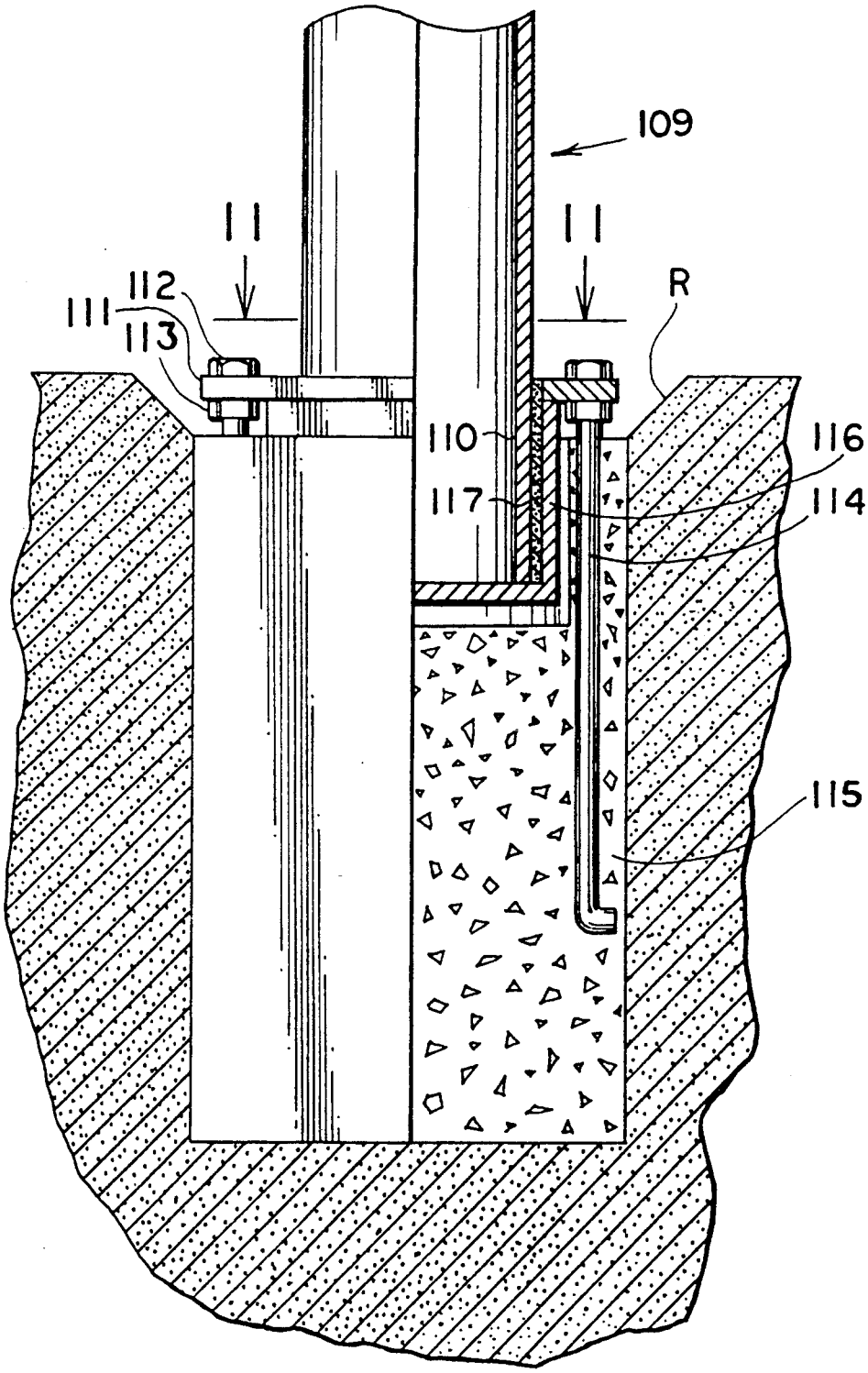
FIG. 10 is a vertical cross-sectional view, partly in elevation, of a fourth embodiment showing the bottom end of a round breakaway utility pole mounted telescopically in the novel inverted base structure.

In the fourth embodiment, depicted in FIG. 10, the pole 109 is perferably tubular, and it may be straight or tapered longitudinally and circular or polygonal in cross-section. It, too, may be made from any of several materials such as steel, aluminum or other metals, or reinforced plastic such as fiberglass. It must be strong enough to resist top and wind loading, while subject to failure when tested as prescribed by the American Association of State Highway Transportation Officials publication entitled "Standard Specifications for Structural Supports for Highway Signs, Luminaries and Traffic Signals 1985". Accordingly, the more acceptable materials for breakaway poles are relatively lightweight such as aluminum or reinforced plastics such as fiberglass.

The lower end portion 110 of pole 109 is telescopically received in a base which has a peripheral flange 111 secured by nuts 112 and 113 to the upper ends of anchor bolts 114 which are embedded in a concrete foundation 115. The base may be constructed of various materials, such as aluminum, steel, bronze or reinforced plastic. The base is inverted in the sense that its ferrule or tubular portion 116 depends from the base flange 111 below ground level, with the flange being substantially at or slightly below ground level and the upper nuts 112 no more than 4 inches above it. Accordingly, the top of the foundation 115 is preferably spaced below ground level to allow formation of a beveled recess R around the flange 111, facilitating access to the anchor nuts 112 and 113. The usual design of an anchor base includes a peripheral base flange at or near ground level and a tubular ferrule extending upwardly therefrom far above the 4 inch limit to encircle the pole, which tends to cause difficulties when the pole is broken away, by leaving a stub above the maximum 4 inch projection required.

As shown, the lower end portion 110 of the pole 109 is bonded to the tubular portion 116 by a thin layer 117 of adhesive material coextensive longitudinally with tubular portion 116, which material may be of an epoxy such as Versamid® formulated to fail and release the pole when subjected to impact under the conditions prescribed previously herein. The thickness of the adhesive bond 117 may be from about 1/16 inch to 3/16 inch. As shown in FIG. 10, a clearance is provided between the side and bottom walls of the tubular portion 116 of the base and the socket in the concrete foundation 115 which receives it, to facilitate adjusting alignment of the pole to vertical.

Figure 13:
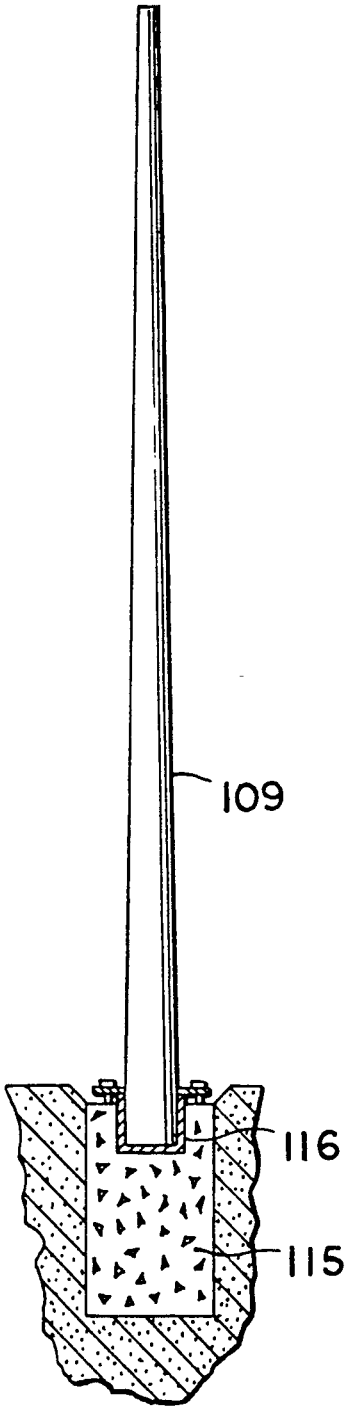
FIGS. 13, 14 and 15 are schematic vertical cross-sectional views showing the progressively changing positions of the pole when breaking away due to horizontal impact by a moviong force.
Figure 14:
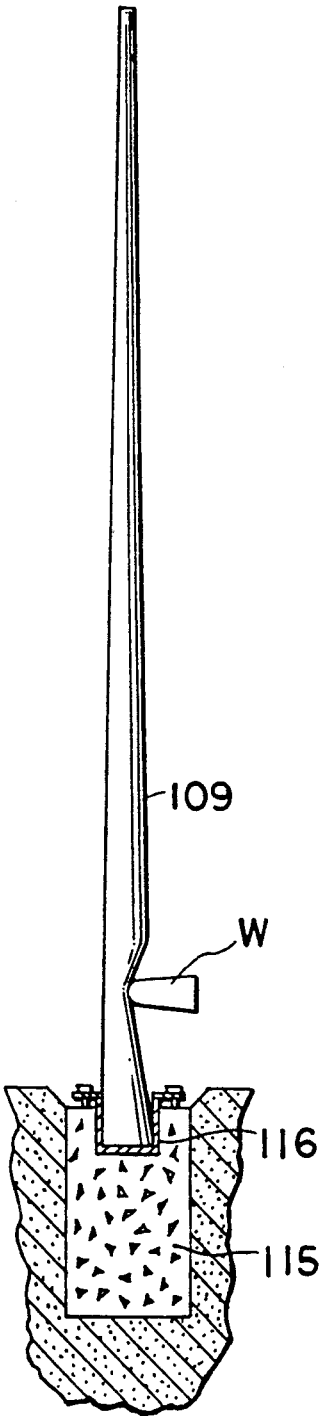
Figure 15:
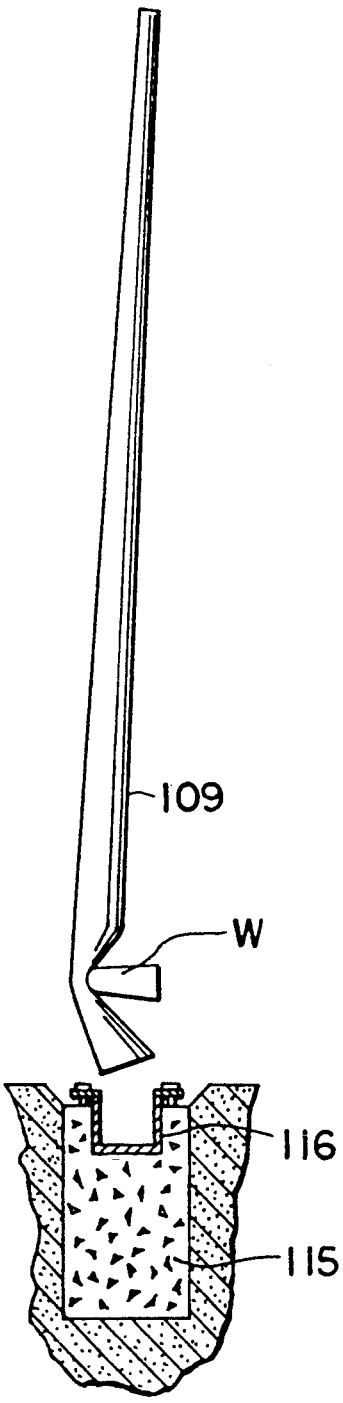

In the sequential depiction of stages in a test, FIG. 13 shows the position of the pole and its mounting before impact, FIG. 14 shows the conditions at impact, and FIG. 15 shows the conditions immediately after impact as the crushed lower end of the pole is being evacuated from the inverted base.

Figure 11:
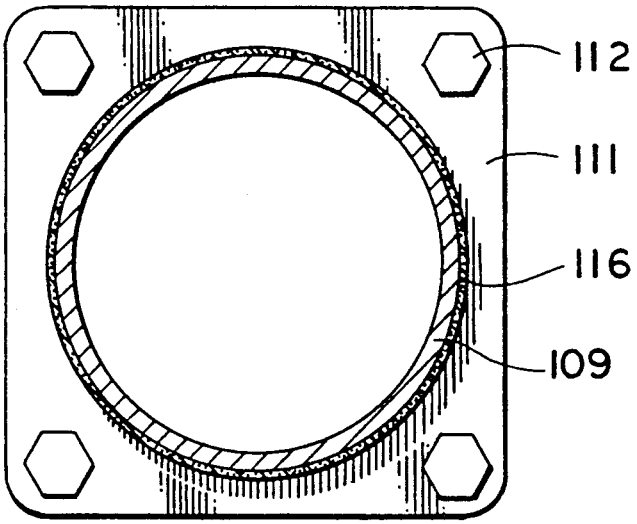
FIG. 11 is a plan sectional view on line 11—11 of FIG. 10.

A tapered tubular fiberglass pole 109 having a square cross-section, as shown in FIG. 11, was mounted in an inverted base anchored in a concrete foundation in the ground, as shown in FIG. 10. The pole extended 24 feet above ground and had an outer cross-sectional dimension of $4\frac{3}{4}$ inches at the top with a wall 7/16 inch in thickness, and a cross-section of $6\frac{3}{4}$ inches immediately above the base with a wall thickness of 5/16 inch. The tubular portion 116 of the base extended 6 inches below ground.

The pole 109 was tested as required by an 1800 pound weight W moving horizontally at 20 miles per hour striking the pole 18 inches above ground and the pole was crushed and evacuated from the base in the manner depicted in FIGS. 13, 14 and 15. The change in velocity of the striking weight simulating that of a moving vehicle was from 30.92 feet per second before impact to 26.19 feet per second after impact, a difference of 4.13 feet per second. This result is well within the requirements of the American Association of State Highway Transportation Officials; namely, speed reduction of not more than 15 feet per second, and perferably not more than 10 feet per second. There was no projection of the remaining base structure extending more than 4 inches above ground level.

Figure 12:
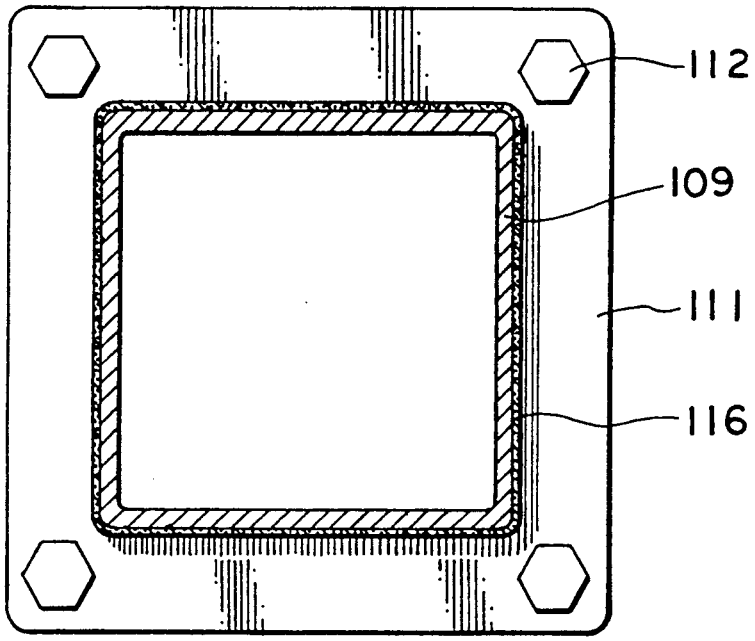
FIG. 12 is a similar view showing a pole of square cross-section.

A pole 109' having a circular cross section, as shown in FIG. 12, and approximately the same dimensions as the pole 109 depicted in FIG. 11, was tested with an 8 foot long luminaire mounting arm attached to the pole 9 inches from the top. A 50 pound weight was attached to the end of the arm to simulate the mass of a luminaire. The test was preformed as described in connection with square pole 109. The change in velocity of the impacting force was from 31.24 feet per second before impact to 21.29 feet per second after impact, namely 9.95 feet per second, well within the requirements.

Figure 17:
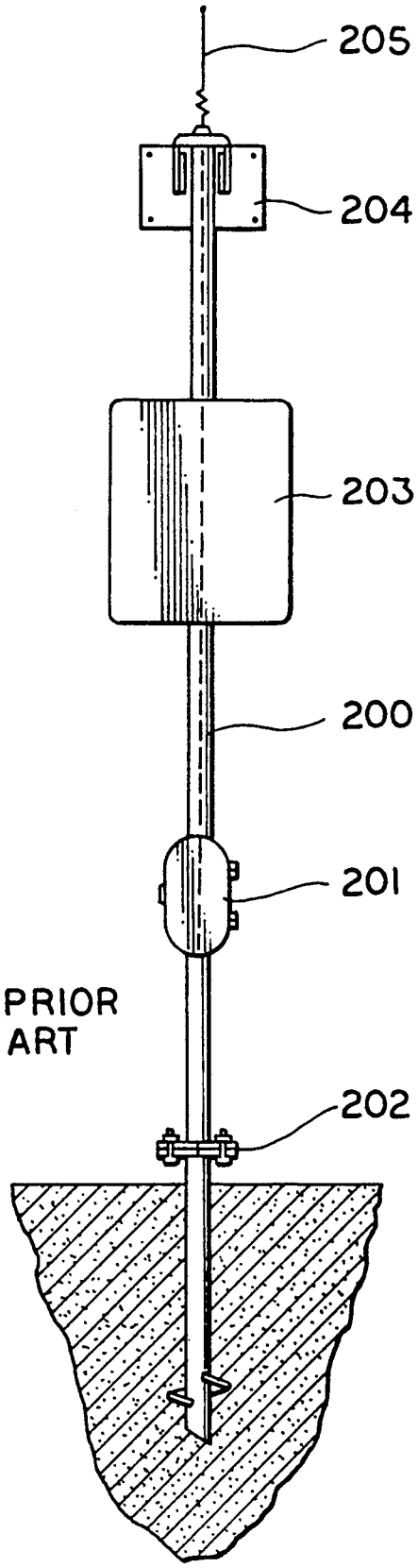
FIG. 17 is a similar view of a prior art utility pole for mounting a call box.
Figure 16:
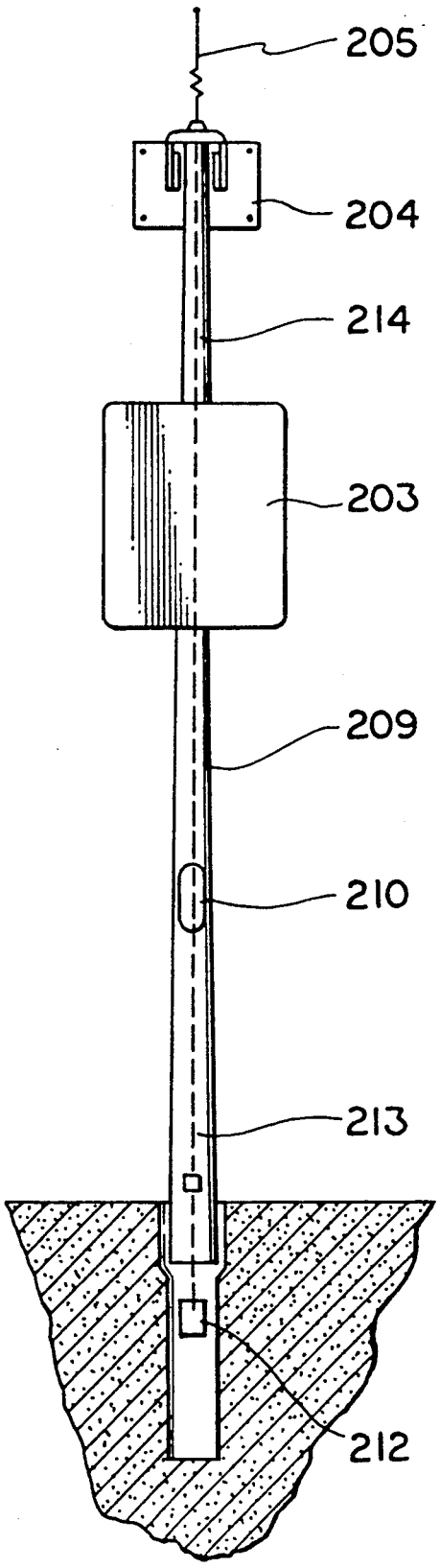
FIG. 16 is a vertical sectional view, partly in elevation, showing a pole having a base structure similar to that of FIG. 6, and adapted for mounting a telephone call box along a highway.
Figure 19:
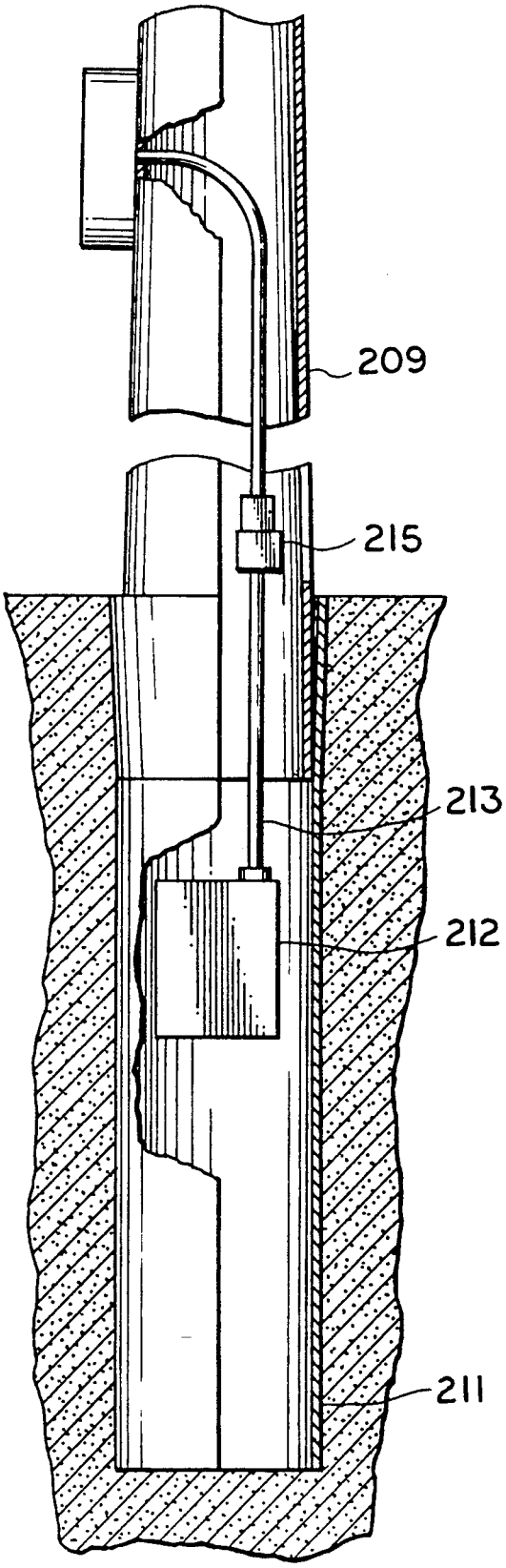
FIG. 19 is a vertical sectional view similar to FIG. 16, showing a pole having a base structure similar to that of FIG. 1, and adapted for mounting a telephone call box.
Figure 18:
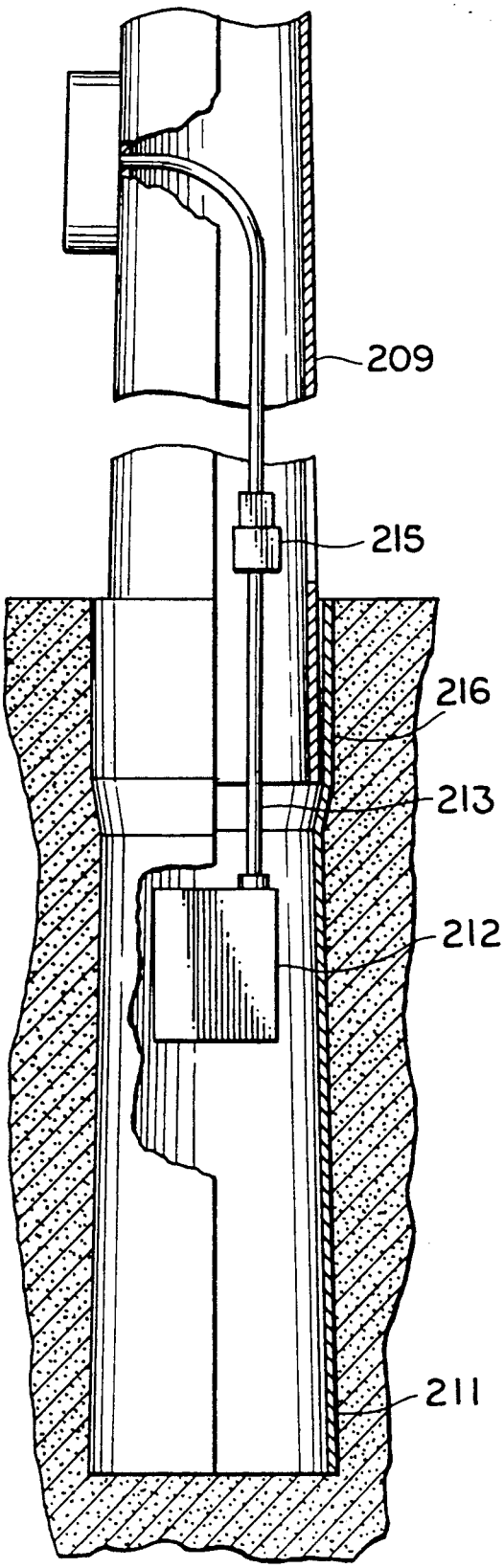
FIG. 18 is an enlarged vertical sectional view partly in elevation, showing the bottom end of the pole of FIG. 16 received in a tubular base structure similar to that of FIG. 6.

Referring to FIGS. 16–20 of the drawings, FIG. 17 shows a standard prior art utility pole 200 mounting a telephone call box 201 about four feet above ground level, and having a breakaway connection 202 with a buried base section. The pole also mounts back-to-back call box signs 203 at an upper level and a solar panel 204 at its upper end to charge batteries in the call box. An antenna 205 tops the solar panel.

The standard call box 201 and its contents weight about 60 pounds. Experience has shown that if this prior art telephone pole is struck about 18 inches above ground level by a horizontal moving force such as an 1800 pound vehicle travelling at 20 miles per hour, at breakaway the inertia of the heavy call box at its height above ground level will cause the pole to tip backward onto the vehicle causing the call box to strike the windshield area, thus subjecting the vehicle and its occupants to aggravated damage and severe injury. Moreover, the remaining portions of the standard breakaway connection 202, would quite likely project more than four inches above ground level, presenting an additional hazard.

The breakaway telephone pole 209 shown in FIGS. 16, 18, 19 and 20 carries a substantially smaller and lighter call box 210, weighing no more than about 12 pounds, at the standard height above ground level. This is accomplished by transferring the bulk of the heavy electronic equipment from the call box 210 to a location below ground —i.e.: into a waterproof housing 212 mounted within the base 211, and electrically connecting the equipment to the call box 210 by a cable 213 which extends upwardly through the pole 209. The solar panel 204 is connected by a cable 214 extending through the pole to charge batteries within the call box.

A power supply plug-in cable harness 215 (FIGS. 18 and 19) is mounted in the pole 209 slightly above ground level, and is adapted to pull away when the pole breaks away. This allows the electronic equipment in housing 212 to be reused in conjunction with another pole.

Figure 20:
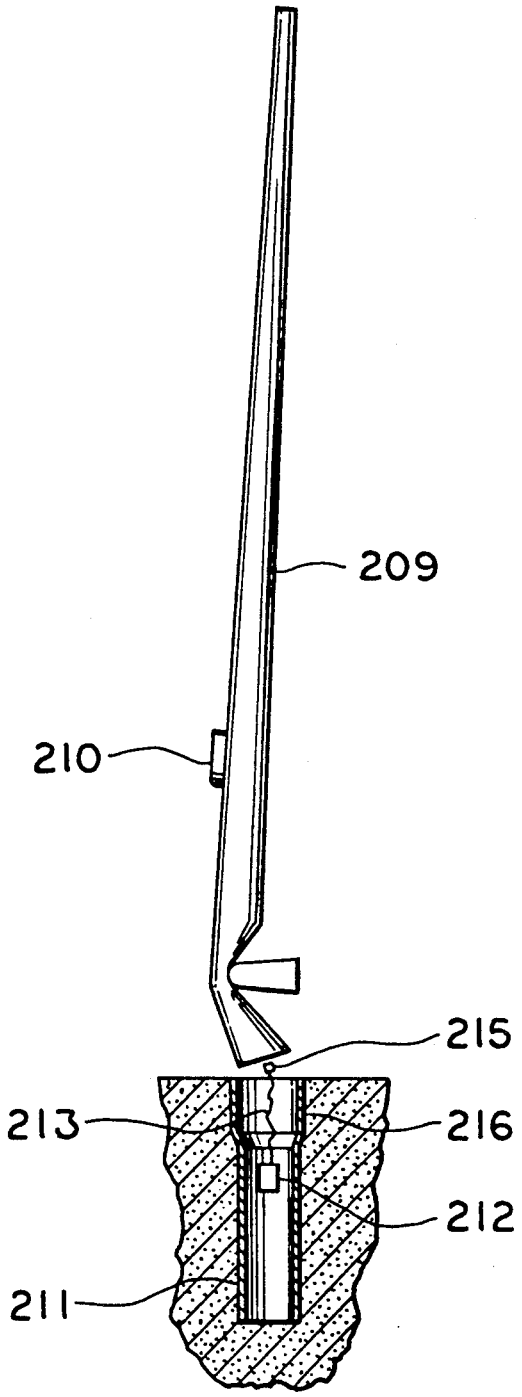
FIG. 20 is a schematic sectional view showing the telephone pole of FIG. 18 as it breaks away due to horizontal impact by a moving force.

As shown in FIG. 20 when the improved call box telephone pole is struck at about 18 inches above ground level by an 1800 pound vehicle travelling horizontally at 20 miles per hour. the pole will remain substantially upright as it breaks away and will, in fact, readily fall away from the vehicle. However, even if the pole 209 should fall upon the vehicle, the light weight call box would cause minimal damage.

As should now be apparent, the present invention provides an improved breakaway pole mounting structure having a variety of novel base configurations which meet the present standard specifications for highway poles and the like, and which not only accomplish the forgoing objectives but also provide a safe means by which to mount a telephone call box.

We claim:

1. A breakaway utility pole mounting structure comprising:

a utility pole having at least one substantially tubular end portion;

a base anchored in the ground substantially below ground level and having a tubular portion extending below ground level, said tubular portion adapted telescopically to enclose said pole end portion;

an adhesive material bonding said pole end portion to said base tubular portion;

said adhesive material adapted to fail and release said pole when it is subjected to an impact at a predetermined distance above the base from a vehicle of predetermined minimum weight moving at a predetermined minimum speed;

and a telephone call box mounted on the pole at a approximately four feet above ground level, said call box being of minimum weight to inhibit the pole from tipping backward over the vehicle on breakaway of said pole.

2. A breakaway utility pole mounting structure as in claim 1, wherein an electronics equipment housing for operating the telephone within said call box is mounted below ground level within the tubular portion of said base, said equipment electrically connected to said call box by a cable within the tubular end portion of said pole.

3. A breakaway utility pole mounting structure as in claim 2, wherein a plug-in cable harness is mounted at ground level on said pole and detachably connected to said cable, said harness adapted to separate said cable on breakaway of said pole.

4. A breakaway utility pole mounting structure as in claim 1, wherein the maximum weight of said call box is about 12 pounds.

5. A breakaway utility pole mounting structure as in claim 4, wherein an electronic equipment housing for operating the telephone within said call box is mounted below ground level within the tubular portion of said base, said equipment electrically connected to said call box by a cable within the tubular end portion of said pole.

6. A breakaway utility pole mounting structure as in claim 5, wherein a plug-in cable harness is mounted at ground level on said pole and detachably connectd to said cable, said harness adapted to separate said cable on breakaway of said pole.

* * * * *